United States Patent [19]

Catania

[11] Patent Number: 5,029,496

[45] Date of Patent: Jul. 9, 1991

[54] FLEXIBLE HEAD HAMMER

[76] Inventor: Salvatore Catania, 28662 Rancho Grande, Laguna Niguel, Calif. 92677

[21] Appl. No.: 372,654

[22] Filed: Jun. 28, 1989

[51] Int. Cl.[5] ..... B25D 1/02

[52] U.S. Cl. ..... 81/22; 81/24

[58] Field of Search ..... 81/20, 22, 24

[56] References Cited

U.S. PATENT DOCUMENTS

| | | | |
|---|---|---|---|
| 1,401,896 | 12/1921 | Ehrhart | 81/22 |
| 1,794,008 | 2/1931 | Forbes | 81/22 |
| 2,702,060 | 2/1955 | Bonnesen | 81/22 X |
| 2,781,805 | 2/1957 | Freeman | 81/22 |
| 3,129,737 | 4/1964 | Citroen | 81/22 X |
| 3,620,159 | 11/1971 | Gould | 81/22 X |
| 4,073,327 | 2/1978 | Pearson | 81/24 |
| 4,266,588 | 5/1981 | Tudisco | 81/22 |
| 4,633,741 | 1/1987 | Yang | 81/22 |
| 4,697,481 | 10/1987 | Maeda | 81/22 |

FOREIGN PATENT DOCUMENTS

| | | | |
|---|---|---|---|
| 586106 | 3/1975 | France | 81/22 |

*Primary Examiner*—James G. Smith

*Attorney, Agent, or Firm*—Weingram & Zall

[57] ABSTRACT

A hammer, for use in absorbing some of the reaction force upon impact, is provided. This hammer included a head and a handle and a connector therebetween. The connector has a hinge and has a spring member. The hinge has a pair of spaced plates fixedly connected to the handle and has a center plate disposed between the pairs of spaced plates and fixedly connected to the head. A hinge pin passes through three respective holes in the three plates. The spring member is a collar composed of a urethane material. The collar encloses the hinge and fits snugly between a flange on the head and a flange on the handle, so that bending of the collar causes a compression force on one side of the collar. The hinge has stop surfaces for limiting tilting of the head in one rotary direction about the hinge pin. The hinge allows tilting in an opposite rotary direction about the hinge pin, and allows compression of the collar. A second embodiment has a spring member which is a bent wire spring member.

2 Claims, 4 Drawing Sheets

FLEXIBLE HEAD HAMMER

FIELD OF THE INVENTION

The invention relates to a flexible head hammer, and in particular, the invention relates to a flexible had hammer having a hinge portion and having a resilient portion for partly absorbing impact head reaction force.

BACKGROUND OF THE INVENTION

The prior art flexible head hammer is described in U.S. Pat. No. 1,919,128 of inventor C.R. Redden, issued July 18, 1933, which is summarized below. Related patents, which are summarized below, include U.S. Patent Nos.:

| | |
|---|---|
| 603,694 | Kavanaugh, Issued May 10, 1898; |
| 777,215 | Meston, Issued December 13, 1904; |
| 826,102 | Hershey, Issued July 17, 1906; |
| 960,655 | Mabey, Issued June 7, 1910; |
| 1,222,971 | Moe, Issued April 17, 1917; |
| 1,407,341 | Veeck, Issued February 21, 1922; |
| 1,822,280 | Ervay, Issued September 8, 1931; |
| 1,919,128 | Redden, Issued July 18, 1933; |
| 2,636,361 | Holden, Issued April 28, 1953; and |
| 3,179,447 | Parr et al, Issued April 20, 1965. |

Kavanaugh, 603,694, disclosed a pivoting broom handle where the handle rides on a pivot rod 5 in a spring-loaded flexible track 7.

Meston, 777,215, discloses a shaft coupling employing a flexible housing 9, which surrounds a coupling in which two solid shafts are abutted against a disk 14. The disk 14 separates the ends of the shafts.

Hersey, 826,102, discloses a golf club with a flexible mounting of the club head to the shaft. The mounting does not include any direct attachment between the club head and the shaft, the "flex" being provided by, in FIG. 2, the strength of the surrounding housing and, in FIG. 3, the combined strength of the housing which may take the form of a spring.

Mabey, 960,655, shows an adjustable brush handle where the handle is pivoted about the pin 5 and is supported by spring connections 21. The connection here is in the form of an elongated tongue on the end of the handle which has a hole at the end of the tongue in which the pin is inserted.

Moe, 1,222,971, discloses another flexible coupling between the handle and a brush. This flexible coupling also employs an elongated portion on the handle which interfits in supports 20 and is connected by pin 24.

Veeck, 1,407,341, discloses a flexible connection between the handle and the head of a mop. The form of connection here is to a pin connection between the handle and the mop head rather, the connection is formed by the strength of the supporting surrounding housing. Flexibility is developed by spring members, or pivoted curved surfaces abutting each other in the housing.

Ervay, 1,822,280, discloses a flexible head hammer. The purpose of the hammer in Ervay is to enable the handle to be used in the manner of FIGS. 5,6. The connection between the head and the handle employs a pin 16. The end of the handle is in the form of several notches 17, 18 and 19, which interfit into protrusion 17. This serves to "lock" the angle of the handle relative to the handle depending on the position of the fitting 20 into any of the three notches 17, 18 and 19. Element 20 is spring-loaded and therefore movable into and out of the respective notches.

Redden, 1,919,128, shows a flexible head claw hammer employing a pivot connection at 18. As best shown in FIG. 2, the head of the hammer employs two arms 17 and a pin 18 formed therein. The handle is connected to the jaws 6 of the pivoting head portion. There is no special configuration at the end of the handle; it merely is surrounded by rotatable hammer head and handle-engaging end portion.

Holden, 2,636,361, relates a support for machine tools. The invention consists of a flexible spherical mass "G" surrounds pin supports 16 and 17 to form the connection in the device.

Parr, et al., 3,179,447, relates to an arrangement for directing the exhaust gases in the exhaust nozzle of a jet of rocket engine.

The prior art flexible head hammer includes a head, a handle, and a connector which has a hinge means and a resilient means that connects the head to the handle and that urges the head to a normal, right angle position on the handle.

One problem with the prior art flexible head hammer in that it is not usable for absorbing part of a reaction force which is directed to the impact portion of the head when a user is applying an impact force.

SUMMARY OF THE INVENTION

According to the present invention, a flexible head hammer is provided for use is absorbing part of a reaction force caused by an impact force. This hammer includes a head and a handle and a connector, which has a hinge means that connects the head to the handle, and which has a resilient means that applies a spring force that is directed opposite to a reaction force on the head during impact.

By using the hinge means and the resilient means, the problem is avoided of not being able to absorb part of the reaction force which is directed to the impact portion of the head when a user is applying an impact force.

The foregoing and other objects, features and advantages will be apparent from the following description of preferred embodiments of the invention as illustrated in the accompanying drawings.

DESCRIPTION OF THE PREFERRED EMBODIMENT

Figure 1:
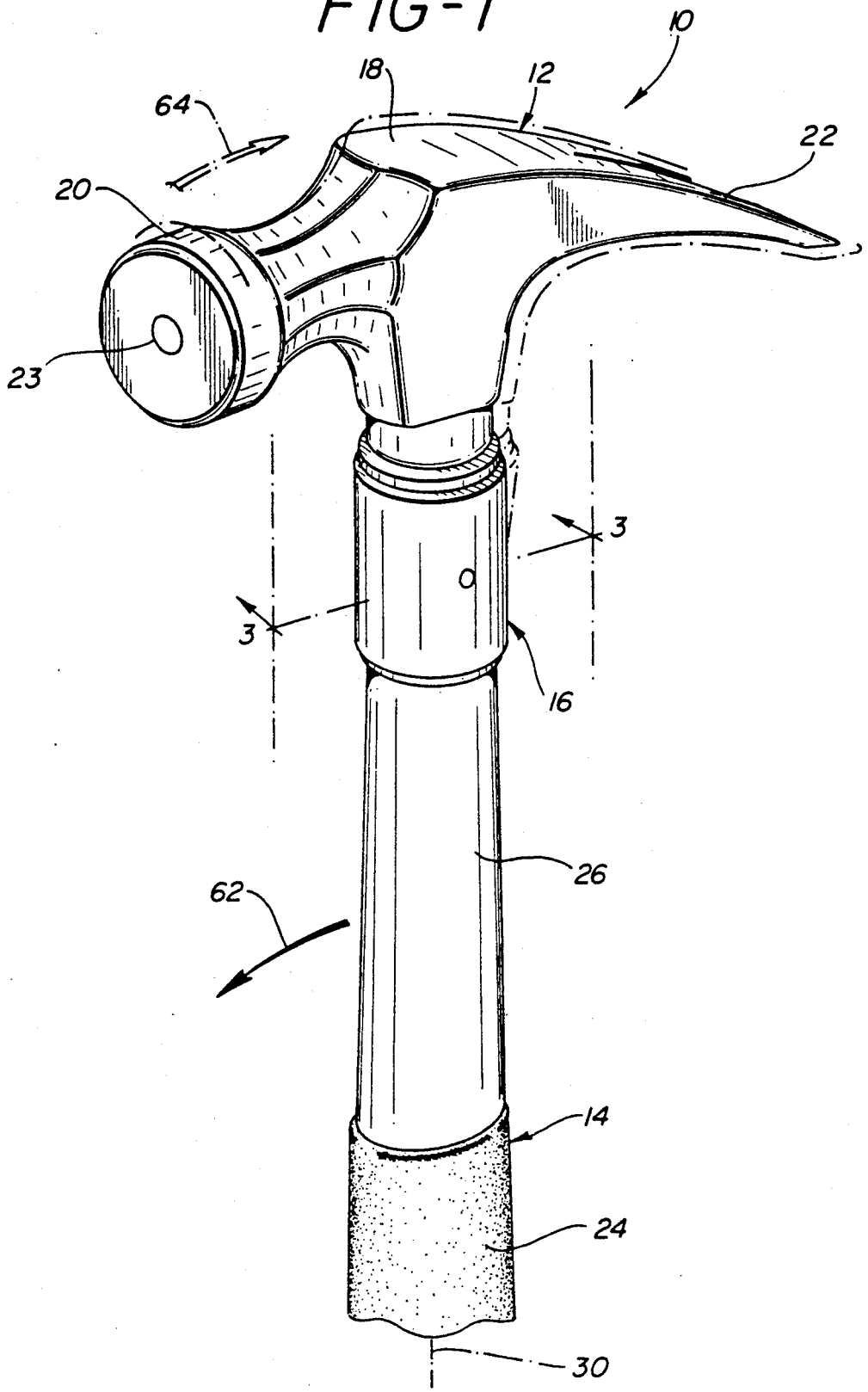
FIG. 1 is a perspective view of a first embodiment of a hammer according to the invention.
Figure 2:
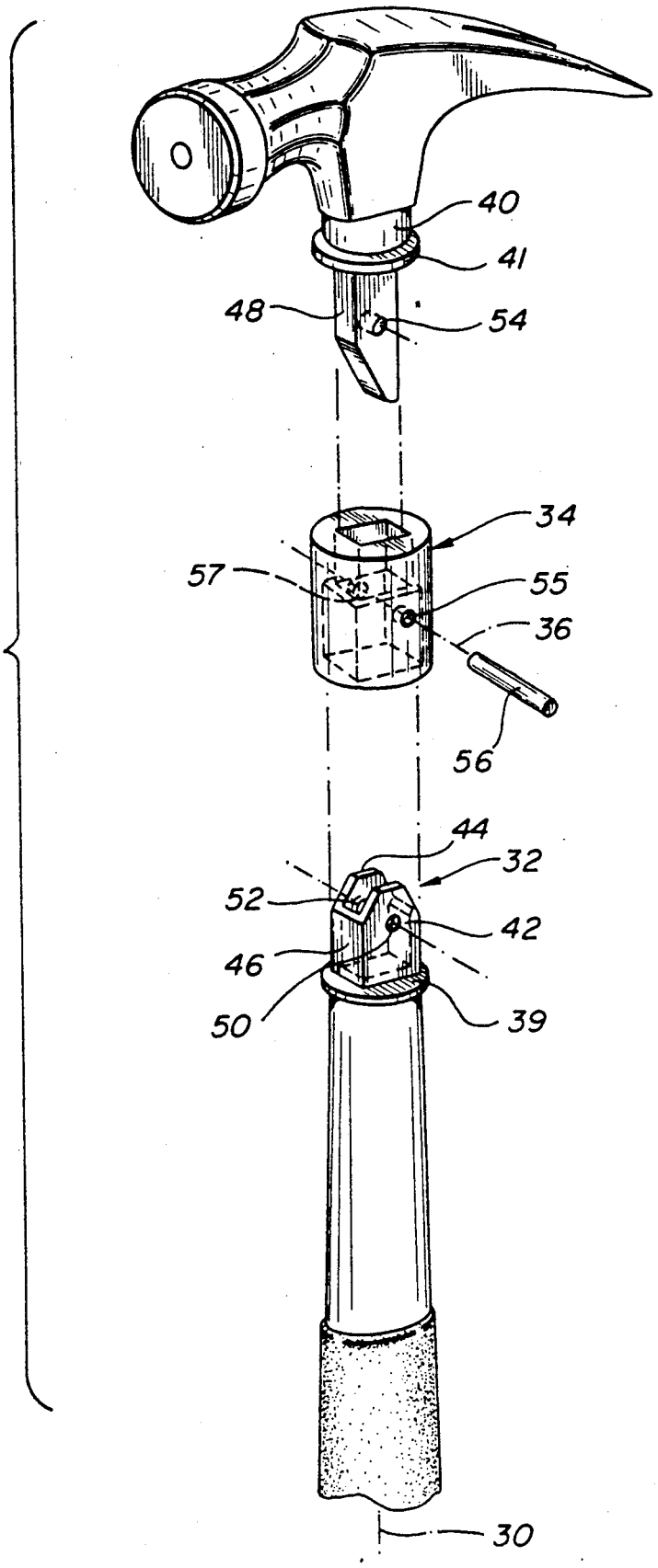
FIG. 2 is an exploded view of the hammer as shown in FIG. 1.

As shown in FIGS. 1 and 2, a hammer assembly or hammer 10 is provided. Hammer 10 includes a head portion 12, and a handle portion 14, and a connection means or connector 16. Head 12 has a center portion 18, and an impact portion 20, and a claw portion 22. Impact portion 20 has a magnet 23 which is imbedded therein for ease of holding a nail while first hitting the nail.

Handle 14 has a grip portion 24, and a shank portion 26. Portions 24 and 26 are coaxial along an axis of symmetry 30.

Connector 16 has a hinge means 32, and has a resilient means or resilient collar or flexible sleeve or flexible collar 34. Collar 34 has a spring rate, which is designed to suit the range of impact forces as expected. Hinge 32 has a hinge axis 36.

Hinge 32 includes shank 26 and which has a lower flange portion 39. Hinge 32 also includes an upper cylindrical portion 40, which is fixedly connected to center portion 18, and which has an upper flange portion 41. Shank 26 has a lower front plate 42, and a lower rear plate 44, and a lower left side plate 46, and a lower right side plate 47. Plates 42, 44, 46, 47 are fixedly connected to shank 26 and form a four-sided assembly. Upper cylindrical 40 has an upper center plate 48, which fits between front plate 42 and rear plate 44. Front plate 42, rear plate 44, and center plate 48 have respective holes 50, 52, 54. Collar 34 has a pair of holes 55, 57. Holes 50, 52, 54, 55, 57 receive a hinge pin 56.

Figure 3:
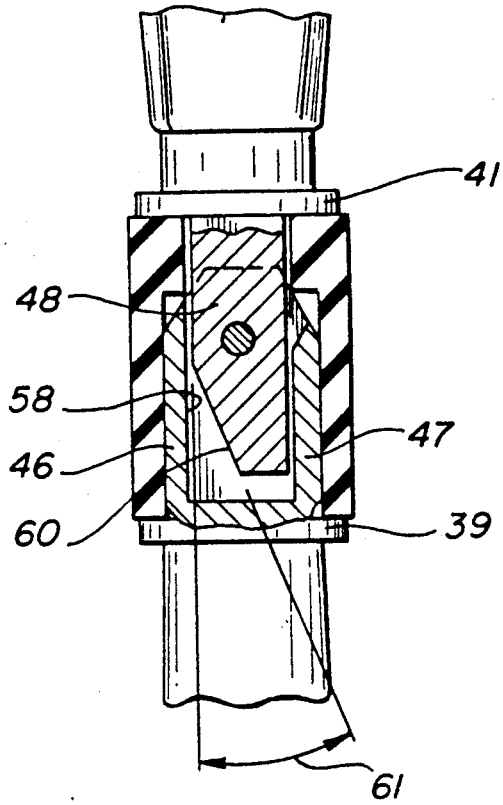
FIG. 3 is a section view of a portion of FIG. 2.

As shown in FIG. 3, lower side plate 46 has a vertical interior bearing surface 58. Upper center plate 48 has an inclined exterior bearing surface 60 which has an inclination angle 61 relative to axis 30, when axis 30 is in its normal aligned position. Surfaces 58, 60 exact as a stop means.

As shown in FIG. 1, when hammer 10 is in use, handle 14 receives an applied moment 62, which is applied by a user (not shown). Upon impact, head impact portion 20 receives a reaction force which causes a reaction moment 64 about hinge pin 56. Reaction moment 64 causes head 12 to displace angularly through a twist or tilt angle, up to a maximum twist angle 66 which is about equal to angle 61. The maximum twist angle 66 occurs when surfaces 58 and 60 are in contact.

Figure 4:
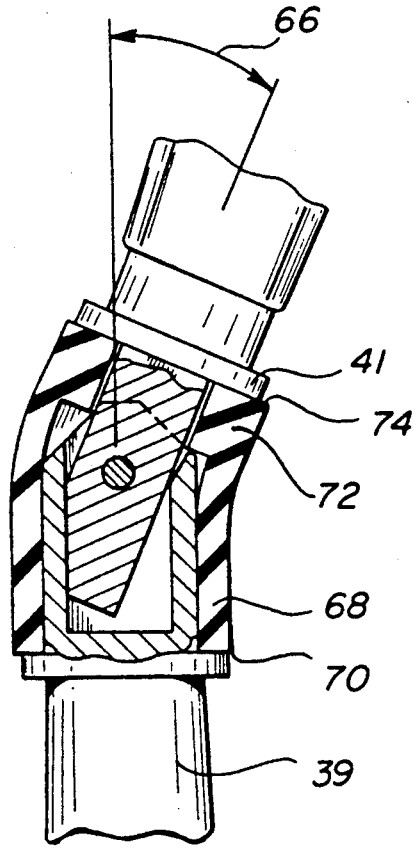
FIG. 4 is a section view of the portion shown in FIG. 3 except in a tilted position.

Collar 34 has a lower cylindrical wall portion 68, which has a lower end face 70. Collar 34 also has a thicker, upper cylindrical wall portion 72, which has an upper end face 74. When head 12 is in a deflected position, as shown in FIG. 4, upper face 74, at its compressed area, bears against upper flange portion 41, and lower face 70, at its compressed area, bears against lower flange portion 39.

Collar 34, in this embodiment, is composed of a urethane material. Portions 68, 72 have the same outside diameter dimension. The upper portion 72 has an inside diameter, which is smaller than the inside diameter, of the lower portion 68, and which fits snugly over center plate 48, for ease of bending collar 34.

Figure 5:
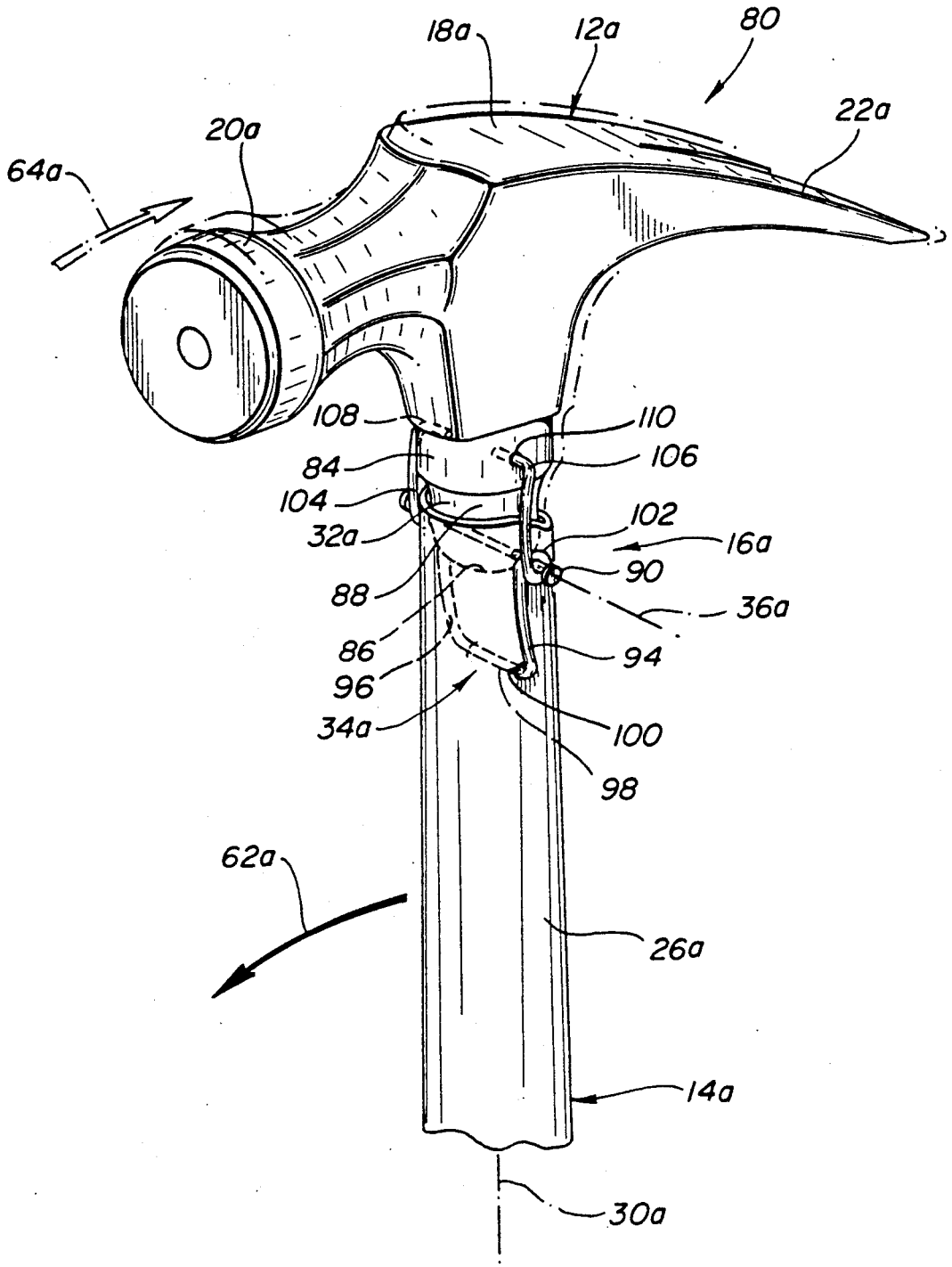
FIG. 5 is a perspective view of a second embodiment of a hammer according to the invention.

As shown in FIG. 5, a second embodiment of hammer 80 is provided. Parts of hammer 80 of FIG. 5 which are the same as corresponding parts of hammer 10 of FIGS. 1 through 4 have the same numerals, but with a subscript "a" added thereto.

Hammer 80 has a head **12*a* and a handle 14*a* and a connector 16*a*. Head 12*a* has a center portion 18*a* and an impact portion 20*a* and a claw portion 22*a*. Handle 14*a* has a grip portion (not shown) a shank portion 26 with an axis 30*a***.

As shown in FIG. 5, connector **16*a* has a hinge means 32*a* and has a spring means 34*a*. Hinge 32*a* has a hinge axis 36*a*. When in use, an applied moment 62*a* on handle 14*a*, as applied by a user, causes a reaction moment 64*a* upon impact, thereby deflecting head 12*a* about axis 36*a* relative to handle 14*a***.

Hinge **32*a* includes shank 26*a* and an upper cylindrical portion 84. Shank 26*a* has a recess 86, which has an inner surface that has a selective shape. Upper cylindrical portion 84 has an extension 88, which has an end surface that has a selective shape for angular displacement of extension 88 relative to recess 86 about axis 36*a***.

Hinge **32*a* has a hinge pin 90, which is disposed along axis 36*a*. Pin 90 extends through lower cylindrical portion 82 adjacent to recess 86. Pin 90 also extends through extension 88**.

Extension 88 has a construction, which is similar to the construction of center plate 48 of hammer 10 of FIGS. 1 through 4.

In an alternate construction, extension 88 has an end surface of semi-shperical shape, and recess 86 has a concave surface of semi-spherical shape.

Spring **34*a* has a U-shaped lower portion 92, which has a near leg portion 94 and which has a far leg portion 96 and which has a transverse portion 98. Transverse portion 98 extends through a hole 100 in shank 28*a*. Spring 34*a* also has a near bent portion 102 and has a far bent portion 104. Bent portions 102, 104 wrap around respective ends of hinge pin 90. Spring 34*a* has a near L-shaped portion 106 and has a far L-shaped portion 108. L-shaped portion 106 is received in a respective hole 110 in cylindrical portion 84. L-shaped portion 108 is also received in a corresponding hole (not shown) in cylindrical portion 84**.

The advantage of hammer 10 is that it is able to absorb part of the reaction force, which is directed to the head when a user is applying an impact force. Another advantage of hammer 10 is that the forces on the arm of a user due to applying an impact force with the hammer are minimized.

The advantages of hammer 80 ar that it has the above benefits of hammer 10, and also its spring and hinge are an all-metal construction.

While the invention has been described in its preferred embodiment, it is to be understood that the words which have been used are words of description rather than limitation and that changes may be made within the purview of the appended claims without departing from the true scope and spirit of the invention in its broader aspects.

For example, in an application where the impact force and reaction force and movement are relatively small in magnitude, the hinge means 32 can be omitted in the embodiment of FIGS. 1 through 4, and the resilient collar can be bonded to head 12 and to handle 14, using an adhesive between upper flange 41 and upper end face 74 and using an adhesive between lower flange 39 and lower end face 70.

What is claimed:

1. A hammer comprising:

a head having an impact portion;

a handle having a longitudinal axis;

connection means connecting the head to the handle, said connection means comprising:

hinge means for angular displacement of the head relative to the handle about a hinge axis, said hinge means comprising:

a lower support portion fixedly connected to the handle;

an upper support portion fixedly connected to the head;

a lower hinge portion fixedly connected to the lower support portion;

an upper hinge portion fixedly connected to the upper support portion;

a hinge pin extending through the lower hinge portion and the upper hinge portion and disposed among the hinge axis; and stop means for limiting the angle of displacement of the upper hinge portion relative to the lower hinge portion; and spring means for urging the head to a normal angular position disposed at a right angle to the handle, and for partly absorbing a reaction force on the head during impact of the impact portion, said spring means comprising a bent wire member disposed radially outward of said hinge means, said spring means comprising:

a near leg portion;

a far leg portion;

a transverse leg portion extending through a hole in the handle and connecting to the near and far left portions;

a near bent portion connecting to the near leg portion;

a far bent portion connecting to the far leg portion;

said near and far bent portions being bent around respective near and far portions of the hinge pin;

a near L-shaped portion connecting to the near bent portion; and a far L-shaped portion connecting to the far bent portion;

said near and far L-shaped portions being received in respective holes in the head.

2. A hammer comprising:

a head having an impact portion;

a handle having a longitudinal axis;

connection means connecting the head to the handle, said connection means comprising:

hinge means for angular displacement of the head relative to the handle about a hinge axis, said hinge means comprising:

a lower support portion fixedly connected to the handle;

an upper support portion fixedly connected to the head;

a lower hinge portion fixedly connected to the lower support portion;

an upper hinge portion fixedly connected to the upper support portion;

a hinge pin extending through the lower hinge portion and the upper hinge portion and disposed along the hinge axis; and stop means for limiting the angle of displacement of the upper hinge portion relative to the lower hinge portion;

wherein, said lower hinge portion includes a lower front plate and a lower rear plate and a lower side plate connection to the lower front plate and to the lower rear plate; and wherein said upper hinge portion includes a center plate extending axially outwardly and being disposed between the lower front plate and the lower rear plate; and wherein said stop means includes an inclined outer bearing surface on said center plate and a vertical inner bearing surface on said end plate, said inclined surface being inclined at an angle to the handle longitudinal axis in a normal right-angle position of head relative to handle; and spring means for urging the head to a normal angular position disposed at a right angle to the handle, and for partly absorbing a reaction force on the head during impact of the impact portion.

* * * * *